United States Patent [19]

Kollmann et al.

[11] 4,162,935

[45] Jul. 31, 1979

[54] PAPIER-MACHÉ COFFIN AND METHOD OF MAKING IT

[75] Inventors: Harry Kollmann, Calgary, Canada; Roland H. Goetsch, Milwaukee, Wis.

[73] Assignee: Idra AG, Switzerland

[21] Appl. No.: 801,858

[22] Filed: May 31, 1977

Related U.S. Application Data

[62] Division of Ser. No. 618,753, Oct. 2, 1975, Pat. No. 4,034,447.

[51] Int. Cl.[2] ..... D21J 7/00

[52] U.S. Cl. ..... 162/220; 162/227; 162/228; 162/391; 162/401

[58] Field of Search ..... 162/218, 220, 227, 228, 162/230, 231, 401, 387, 391; 229/2.5 EC, 2.5 R

[56] References Cited

U.S. PATENT DOCUMENTS 3,128,932 4/1964 Reifers ..... 229/2.5 EC 3,275,213 9/1966 Reifers ..... 229/2.5 EC 3,850,793 11/1974 Hornbostel et al. ..... 162/228

*Primary Examiner*—S. Leon Bashore

*Assistant Examiner*—William F. Smith

*Attorney, Agent, or Firm*—Cyril M. Hajewski

[57] ABSTRACT

A coffin for a human being molded of papier-maché. The coffin is formed with ribs that provide strength to the structure and at the same time have a decorative effect. The improved method of forming the coffin includes drawing paper pulp onto the molds while the latter are inverted so that there is a heavy flow of pulp by gravity to the open end of the coffin to produce heavier flanges. When the mold is received from the pulp with the coffin molded onto it, an air impervious blanket is placed over the coffin when the vacuum is applied to suction the water from the papier-mache so that greater compression of the pulp is obtained to produce a stronger papier-mache structure and reduce the drying time.

7 Claims, 11 Drawing Figures

2
71L
31L
65L
70
66L
72L
62L
60L
85
32
83
57R
56R
30
81
46
50
43
80
48
51
47
82
2
45
41
40

15
17
20

11
10
20
18
20
22
21
20
11
20
10
16

Fig. 3
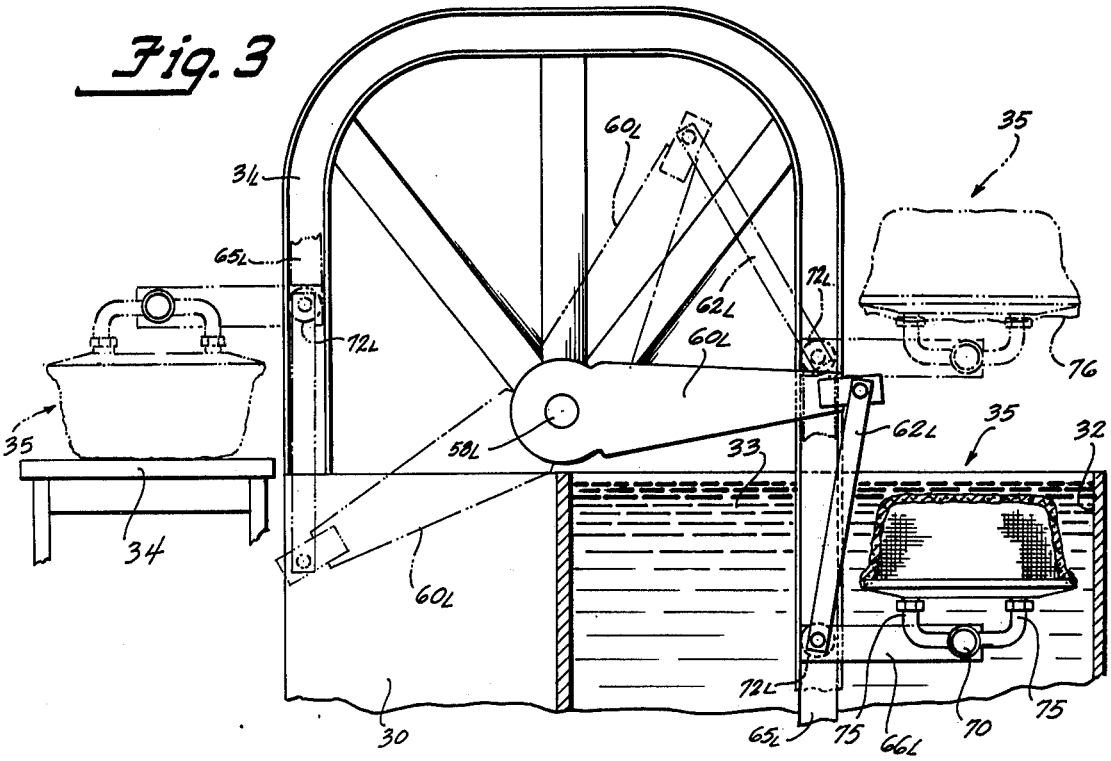
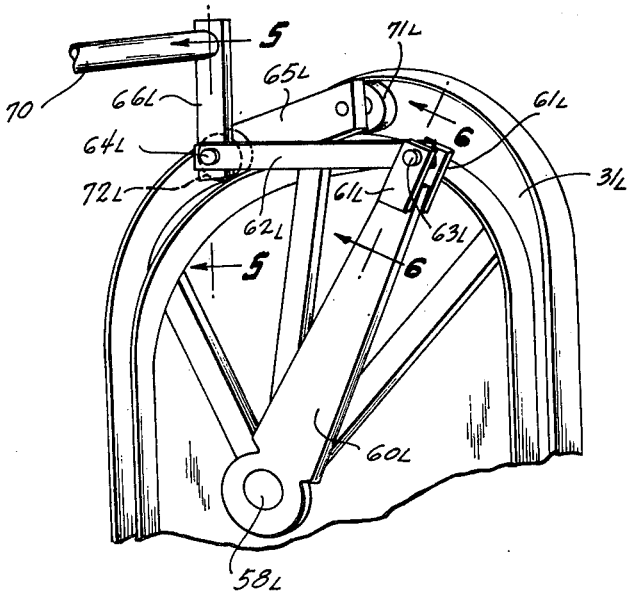
Fig. 4
Fig. 5
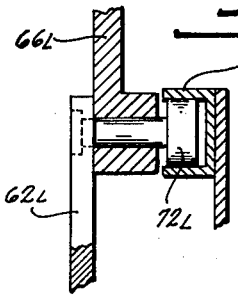
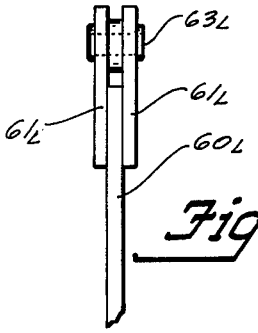
Fig. 6

PAPIER-MACHÉ COFFIN AND METHOD OF MAKING IT

This application is a division of our copending application Ser. No. 618,753 filed Oct. 2, 1975 for a Papier-Mache Coffin and Method of Making it now U.S. Pat. 4,034,447.

BACKGROUND OF THE INVENTION

Relatively small receptacles, such as vases, have been made of papier-maché by suctioning paper pulp onto a mold. However, larger articles have not been molded from this material because no way had been found to impart the necessary strength to the relatively large papier-maché structure to withstand the strains that a large article is subjected to. The present invention is directed to the problem of imparting the necessary strength to a large papier-maché article such as a coffin for a human being.

SUMMARY OF THE INVENTION

According to this invention a coffin for a human being is formed of papier-maché and the necessary strength is obtained by novel decorative ribbing about the entire structure and by the improved method of molding the coffin.

The coffin is formed by drawing paper pulp onto a suitable mold by suction while the mold is immersed in the pulp. Contrary to conventional practice the mold is inverted while it is in the paper pulp so that the open end of the coffin, or of its cover, are facing downwardly while they are being formed. This results in a heavier flow of pulp downwardly toward the flanged edges of the coffin and cover to increase the strength along the open edges of the coffin and cover where a failure is most apt to occur.

After a sufficient amount of paper pulp has been drawn onto the mold by suction, the mold is removed from the pulp and then additional suction is applied to the mold to draw water out of the pulp. Another important feature of the present invention lies in covering the coffin shaped paper pulp on the mold with an air impervious blanket while the water is being suctioned out of it. This produces greater compression of the paper pulp to increase the strength of the resulting papier-maché structure and also reduces the drying time after the mold is removed from the formed paper pulp.

The molding machine is designed so that the mold is moved in a vertical path of travel when it is being removed from the coffin shaped paper pulp so that the coffin is not disturbed in any way by the mold as it moves away and there will be no abrasion of the side walls.

It is therefore a general object of the present invention to provide a coffin for a human being formed of papier-maché.

It is a further object of the present invention to provide an improved method of molding paper pulp into a papier-maché article so that the strength of the papier-maché structure is increased to enable relatively large articles to be molded with such large articles being able to withstand heavy loads and strains.

Another object of the present invention is to increase the compression of paper pulp on a mold to increase the strength of the final papier-maché article.

It is also an object of the present invention to mold articles of paper pulp so that heavier thicknesses of the paper flow toward the edges of the article to increase the strength of the final papier-maché article in these critical areas.

The foregoing and other objects of this invention which will become more fully apparent from the following detailed description, may be achieved by means of the exemplifying apparatus depicted in and set forth in this specification in connection with the accompanying drawings.

BRIEF DESCRIPTION OF THE DRAWING

FIG. 3 is another end view of the paper pulp molding machine shown in FIG. 1 with parts being broken away to show the coffin mold immersed in the paper pulp and the transfer arm and coffin being shown in broken lines in two different positions as it progresses out of the paper pulp and onto the table;

FIG. 4 is a fragmentary perspective view illustrating the transfer mechanism which transfers the paper pulp mold between the tank of paper pulp and the drying table;

FIG. 5 is a detail view mostly in vertical section taken along the plane represented by the line 5—5 in FIG. 4;

FIG. 6 is a detail sectional view taken along the plane represented by the line 6—6 in FIG. 4;

Figure 8:
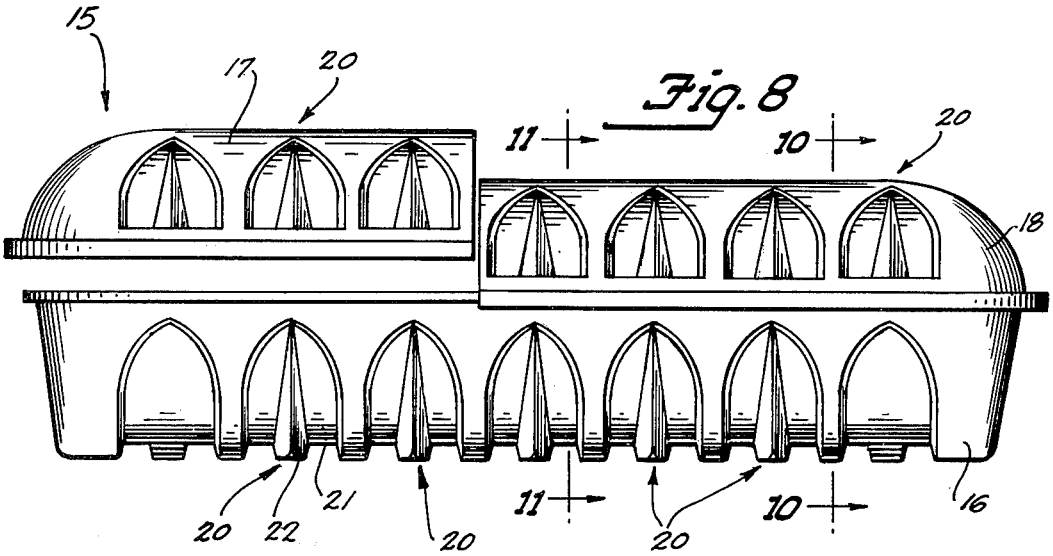
FIG. 8 is a side elevational view of the completed molded papier-maché coffin including its two covers with one of the covers being slightly raised from the coffin.

Reference is now made more particularly to the drawings and specifically to FIG. 8 therein which illustrates a papier-maché coffin constructed in accordance with the teachings of the present invention. As there shown, the coffin is generally identified by the reference numeral 15 and comprises a body 16 having two covers or lids 17 and 18 which together cover the entire coffin 16.

In order to provide strength to the coffin and lids, they are heavily ribbed by a plurality of ribbing structures generally identified by the reference numeral 20. Each of the ribbing structures 20 comprises a recess portion 21 shaped in the form of a lancet arch with a narrow cone shaped protrusion or extension 22 extending outwardly from the recess 21 when the ribbing 20 is seen from the outside of the coffin. It should be understood that the recess 21 will be extending inwardly into the coffin while the cone 22 will be a corresponding recess on the inside of the coffin. Identical ribbing structures 20 are provided on the lids 17 and 18.

Figure 9:
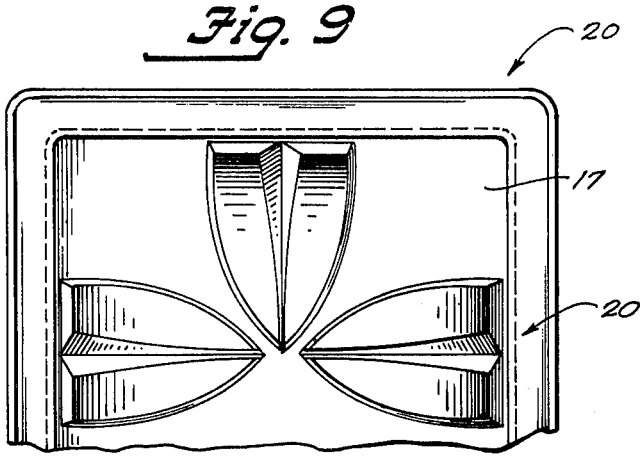
FIG. 9 is a fragmentary plan view of one of the covers to illustrate the design of the ribbing on the covers.
Figure 10:
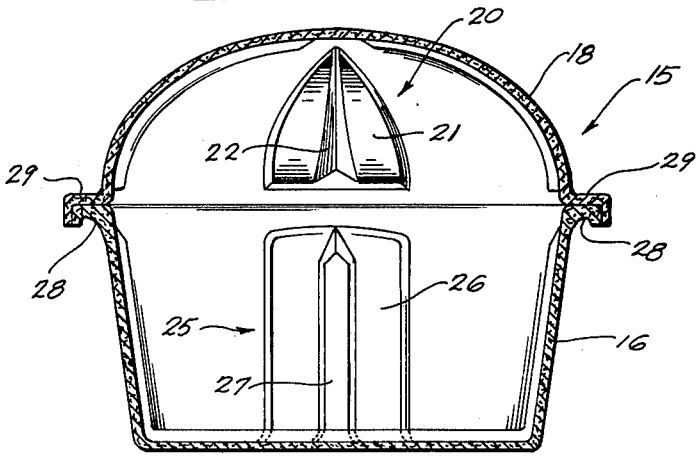
FIG. 10 is a vertical section taken through the coffin along the plane represented by the line 10—10 in FIG. 8.
Figure 11:
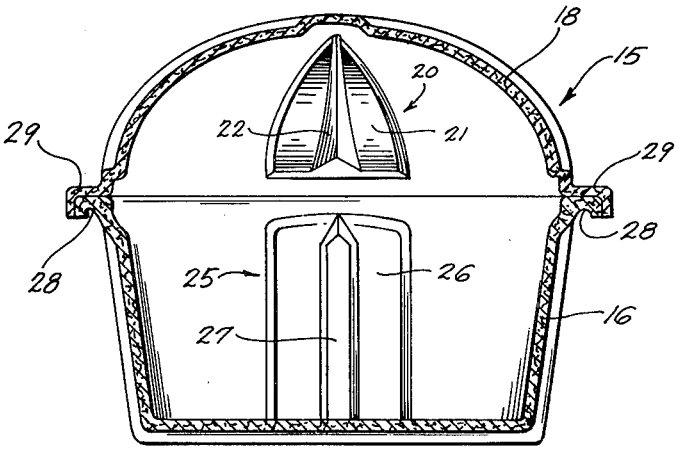
FIG. 11 is a vertical section taken along the plane represented by the line 11—11 in FIG. 8.

As shown in FIG. 9, a ribbing structure 20 is provided at the end of the lid 17 and in like manner a ribbing structure 20 is provided on the opposite end on the lid 18. A different ribbing structure 25 is provided on the ends of the body 16 as shown in FIGS. 10 and 11. This includes a rectangular recess portion 26 when viewed from the exterior of the body 16 and a protruding or extending portion 27 centrally located along the length of the recess 26. In FIGS. 10 and 11 the ribbing structures 25 are being viewed from the interior of the coffin so that the recessed portion 26 actually is extending into the interior of the body 16 while the protrusion 27 is a recess when viewed from the interior of the body 16.

As best shown in FIGS. 10 and 11 the body 16 is provided with an outwardly extending flange 28 which cooperates with a complementary outwardly extending flange 29 on the lid 18 to seal the interior of the coffin when the lid 18 is in place. Although not specifically shown, the lid 17 has an identical outwardly extending flange 29 for cooperation with the flange 28 on the body 16.

Figure 7:
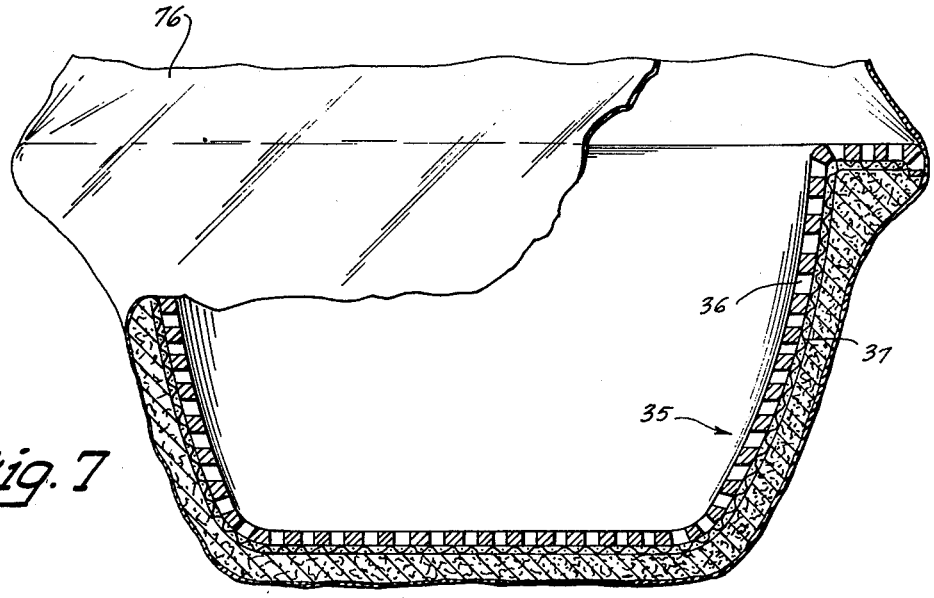
FIG. 7 is an enlarged sectional view taken through the paper pulp mold with the paper pulp applied to the mold and an air impervious blanket over the mold as suction is being applied to the paper pulp for drawing off the water and compressing the pulp.

In view of the large size of the coffin being molded from the paper pulp, the method of molding this coffin becomes extremely important and makes it possible to mold such large coffin of papier-maché and obtain the necessary structural strength to enable the coffin to withstand the loads and strains to which it may be subjected. The apparatus for carrying out the improved method of the present invention is illustrated in FIGS. 1 to 6 and comprises a frame 30 with a pair of tracks 31L and 31R extending above the frame 30. As shown in FIG. 2, the track 31L is on the left side of the frame 30 while the track 31R is on the right side of the frame 30. The frame 30 includes a tank or vat 32 containing a slurry of paper pulp 33. On the opposite side of the machine, as shown in FIG. 3, a table 34 is provided for receiving the coffin mold with the paper pulp on it after the water has been suctioned out of the paper pulp on the mold. The coffin mold is shown in the slurry of paper pulp 33 in FIG. 3 and is identified generally by the reference numeral 35. As clearly shown in FIG. 7, the mold is formed of a perforated sheet 36 having a wire mesh or screen 37 covering its entire outer surface.

Figure 1:
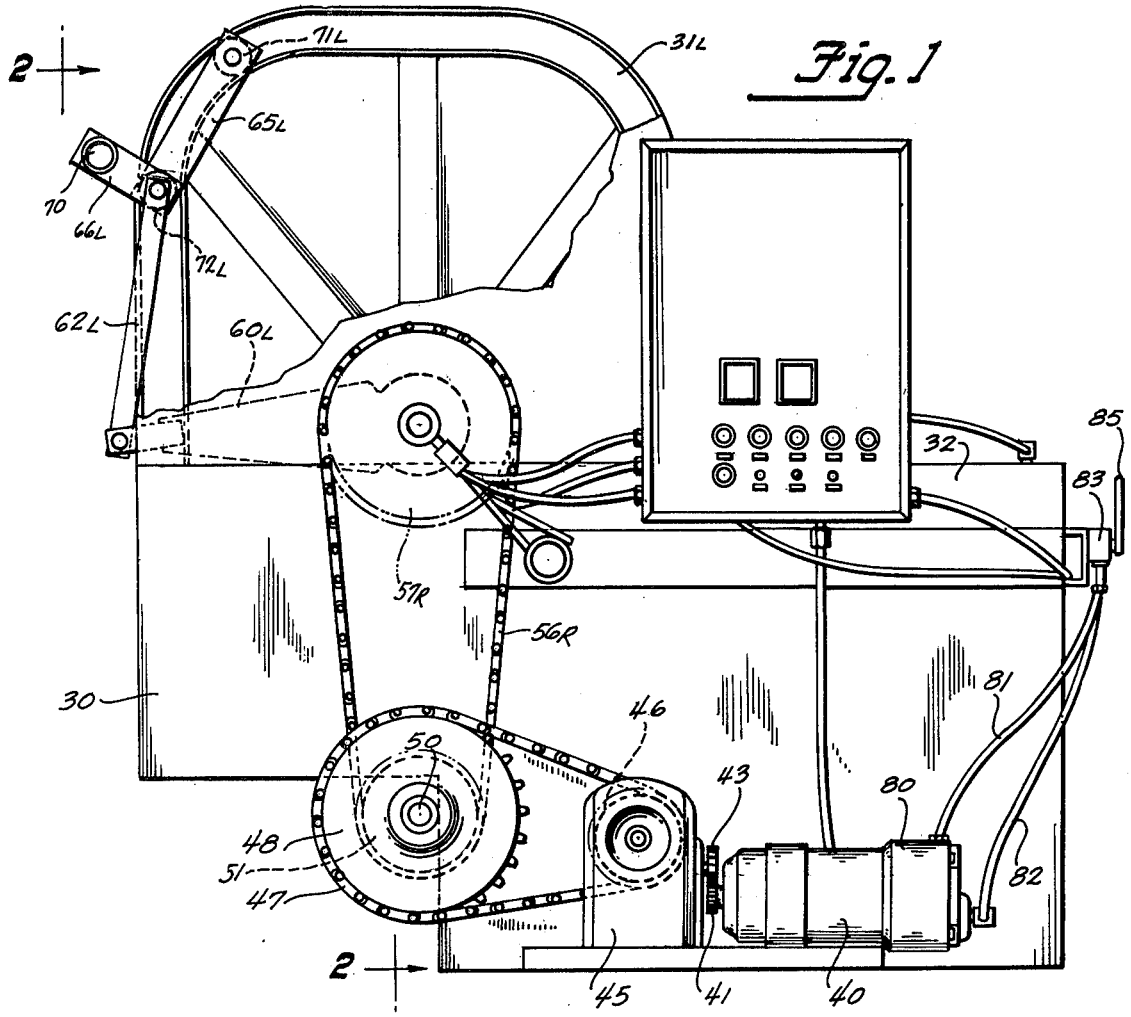
FIG. 1 is a right end view of the paper pulp molding machine used to carry out the present invention with parts being broken away to illustrate the mold transfer mechanism.
Figure 2:
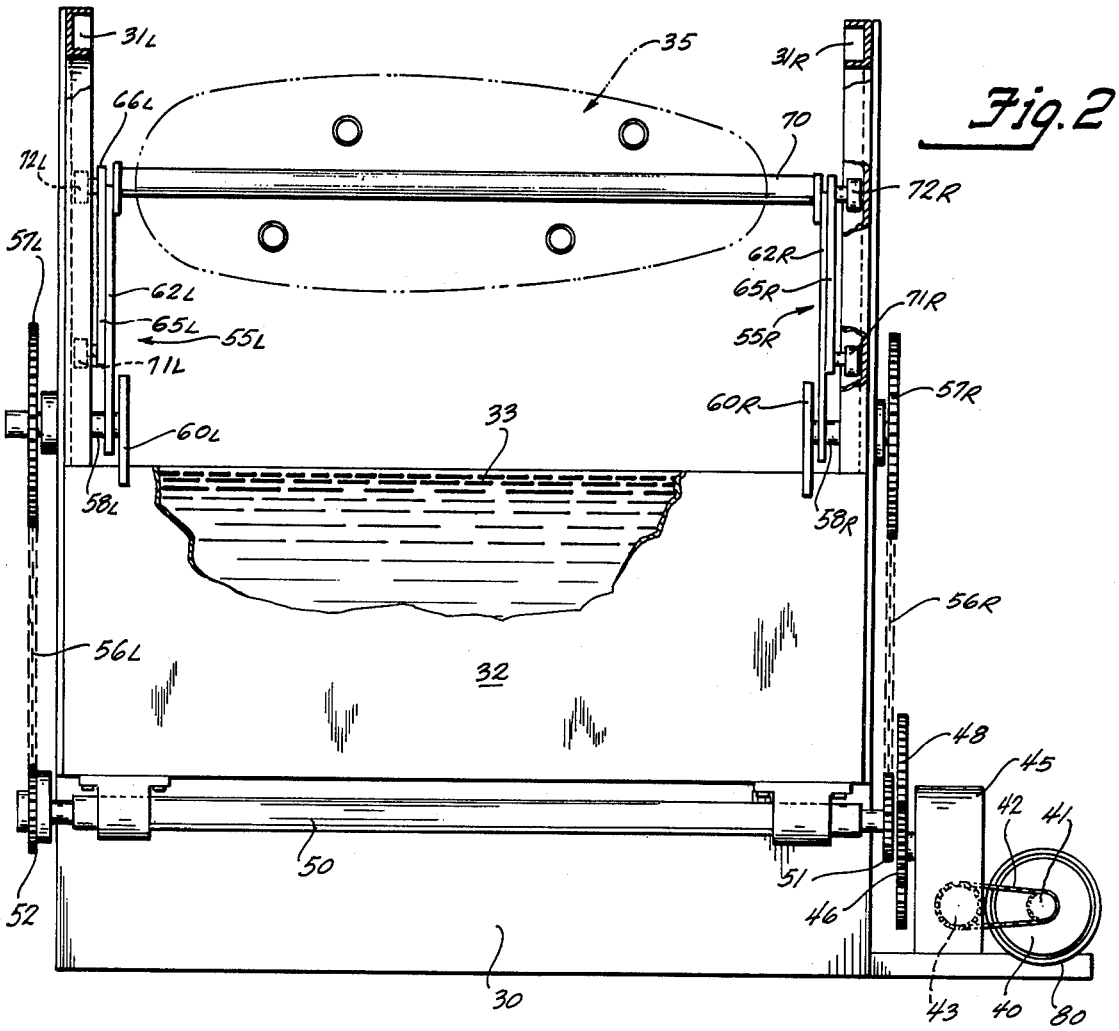
FIG. 2 is a front view of the machine illustrated in FIG. 1 with a portion of the paper pulp tank being broken away to show the paper pulp in the tank and the paper pulp mold being raised above the tank of paper pulp.

The transfer mechanism for transferring the mold from the paper pulp 33 to the position on the table 34, as illustrated in FIGS. 1, 2 and 3, comprises a motor 40 having a sprocket 41 mounted on its output shaft for engagement with a chain 42 which also engages a sprocket 43 keyed to the input shaft of a gear box 45. The output shaft of the gear box 45 is disposed at 90° to its input shaft and has a sprocket 46 keyed to it for engagement with a chain 47 that also engages a large sprocket 48 that is keyed to rotate with a shaft 50 that spans the width of the machine as clearly shown in FIG. 2. The shaft 50 has a sprocket 51 keyed to it adjacent to the sprocket 48 and has an identical sprocket 52 keyed to it at its opposite end. The sprocket 51 drives a linkage generally identified by the reference numeral 55R while the sprocket 52 operates an identical linkage generally identified by the reference numeral 55L. The linkage 55L is on the left side of the machine as viewed in FIG. 2 and the linkage 55R is on the right side of the machine as viewed in FIG. 2. The linkages 55L and 55R cooperate with the tracks 31L and 31R respectively for transferring the mold 35 between the drying table 34 and the tank 32 which hols the paper pulp 33.

The sprocket 51 is in engagement with a chain 56R that engages a large sprocket 57R which is connected to the linkage 55R as will be presently described. In the same manner, the sprocket 52 is in engagement with a chain 56L that is also in engagement with a large sprocket 57L which is connected to the linkage 55L.

Since the linkages 55L and 55R are identical it will be necessary to describe only one of them to understand the operation of the mechanism. As best shown in FIG. 2, the sprocket 57R is keyed to a shaft 58R to which an arm 60R is fixed for rotation therewith. As shown in FIG. 4, an identical shaft 58L carries the arm 60L and the end of the arm 60L opposite the shaft 58 is provided with a pair of spaced plates 61L with a plate 61L being fixed to each side of the arm 60L and extending outwardly therefrom. A link 62L has one end disposed between the two plates 61L, and a pin 63L is secured to the two plates 61L and passes through a suitable opening (not shown) in the link 62L so that the latter can pivot relative to the arm 60L. The opposite end of the link 62L is pivotably connected to a pin 64L which also carries a pair of bars 65L and 66L. The bar 66L is rigidly secured to the bar 65L and supports a pipe 70 that spans the width of the vat 32 and carries the mold 35 as clearly shown in FIG. 2. Accordingly, one end of the tube 70 is secured to the bar 66L and its opposite end is secured to the identical bar 66R on the opposite side of the machine.

The bar 65L has a roller 71L journalled at one end and an identical roller 72L journalled at its opposite end with both of the rollers being disposed within the track 31L so that they guide the movement of the bar 65L in a path determined by the shape of the track 31L. Accordingly, as the shaft 58L is rotated, it produces a corresponding rotation of the arm 60L which moves the link 62L to thereby cause a corresponding movement of the bars 65L and 66L with the path of travel of the bars being determined by the path of travel of the rollers 71L and 72L in the track 31L. The identical linkage is provided on the right side of the machine as viewed in FIG. 2 so that the two linkages move in unison to move the tube 70 and its associated coffin mold 35 in the desired path of travel.

The two tracks 31L and 31R are shaped to guide the linkages 55L and 55R for moving the coffin mold 35 between the tank 32 and the table 34. In FIG. 3, the arm 60L is shown in solid lines supporting the coffin mold 35 in the vat 32 so that the mold is immersed in the paper pulp 33. In that same figure the arm 60L is shown in broken lines in the position to which it is moved to locate the coffin mold 35 out of the paper pulp 33 and above the tank 32 and in the position wherein the mold is moved to the table 34. In FIG. 2, the coffin 35 is shown midway between the tank 32 and the drying table 34 with the coffin having been removed from the paper pulp 33 and raised above both the tank 32 and the drying table 34.

The transfer mechanism is so arranged that when the coffin mold 35 is in the compartment 32, immersed in the paper pulp 33, it is in the inverted position so that, as shown in FIG. 3, the open end of the body 16 of the coffin 15 is disposed with its open end down. It should be understood, that although the mold 35 is for the body 16 of the coffin, the covers 17 and 18 will be formed in an identical manner as suitable molds are provided for them. The lids 17 and 18 will also be positioned in the paper pulp 33 so that their open ends are down with the flanges 29 in the lowermost position. In the case of the body 16 shown in FIG. 3, the flange 28 is in the lowermost position.

With the mold 35 immersed in the paper pulp 33 as shown on the right in FIG. 3, suction is applied to the tube 70 which is in communication with cooperating tubes 75 that, in turn, are in communication with the interior of the mold 35. The tubes are in communication with a vacuum pump 80 in a manner to be described to produce the suction. Since the mold 35 is formed of a perforated plate 36 and the screen 37 as previously described in connection with FIG. 7, the suction draws the paper pulp 33 onto the exterior of the entire mold. As the paper pulp accumulates on the mold 35 a heavier portion tends to cover the mold at its lowermost point because the pulp drops there by gravity. Accordingly, the open edge of the body 16 and the lids 17 and 18 will be thicker in the area of the flanges 28 and 29 so that greater strength is imparted to these critical areas of the coffin.

When the transfer mechanism moves the mold 35 with the paper pulp on it out of the slurry of paper pulp 33 it moves it directly upwardly and then the mold 35, with the paper pulp on it, is wrapped in a blanket 76 which is formed of an air impervious material such as plastic. The mold 35 with the paper pulp on it and wrapped in the blanket 76 is shown in broken lines directly above the tank 32. With the mold in this location, still in the inverted position, the vacuum continues to be applied to draw the water out of the pulp. The air impervious blanket 76, seals the paper pulp from the atmosphere and as the vacuum is applied to the tube 70 for drawing the air out of the interior of the mold 35, the placement of the air impervious blanket 76 about the mold 35 causes the paper pulp on the exterior of the mold to compress to a much greater degree so that the final structure is of a substantially greater strength. The use of the air impervious blanket 76 when applying vacuum to the interior of the mold enables the suction to extract more water from the pulp and expedites the entire drying procedure.

After the water has been thus drawn out of the pulp by the vacuum while the blanket 76 covers the mold 35, the mold is moved by the transfer mechanism to the table 34. While moving the mold the transfer mechanism also invert it so that the mold is on the table 34 in the upright position with the open end of the coffin facing upwardly. The flow of air in the conduits is then reversed so that air pressure is applied to the interior of the mold 35 through the tube 70 and the tubes 75 to blow the paper pulp in the form of the coffin off of the mold onto the table 34. The mold is then withdrawn from the coffin and the tracks 31L and 31R are of such configuration that the mold 35 in its initial movement travels directly upwardly, in a vertical direction, so that it does not rub against the walls of the papier-maché coffin as it is withdrawn from the mold to prevent any abrasion.

This final paper pulp coffin is then thoroughly dried in a drying oven so that it becomes a rigid structure as shown in FIG. 8. A suitable binder is included in the paper pulp 30 so that as it dries it forms a very rigid structure.

The vacuum and air pressure for applying suction to the mold and for applying air pressure to the mold to release the paper pulp coffin from the mold is developed by a pump 80 that is driven by the motor 40. A conduit 81 is coupled to one side of the pump 80 to carry the air pressure while a conduit 82 is connected to the intake side of the pump for carrying a vacuum. Either the conduit 81 or the conduit 82 is selectively placed in communication with the mold 35 through the tubes 70 and 75 by actuating a valve 83 through manipulation of a valve lever 85.

From the foregoing detailed description of the illustrative embodiment of the invention set forth herein it will be apparent that there has been provided an improved papier-maché coffin and an improved method of making it. The coffin design is such that the decorative elements of it also impart strength to the completed structure and the method of forming the elements of the coffin also results in improved strength of the structure by reason of the fact that the paper pulp is applied to the mold while the mold is in the inverted position so that a greater thickness of pulp concentrates at the edges of the coffin and its components, and the placement of the air impervious blanket over the mold while drawing the water out of the paper pulp on the mold causes a greater compression of paper pulp to impart further strength to the material and expedite its drying.

Although the illustrative embodiment of the invention has been described in considerable detail for the purpose of disclosing a practical operative arrangement by means of which the invention may be practised advantageously, it is to be understood that the particular coffin and apparatus illustrated and described is intended to be illustrative only and that the various novel characteristics of the invention may be incorporated in other structural forms and methods without departing from the spirit and scope of the invention as defined in the subjoined claims.

The principles of this invention having now been fully explained in connection with the foregoing description, we hereby claim as our invention:

1. The methed of molding a coffin for an adult human being of papier-maché from molds formed of a pervious material such as screen comprising; immersing the mold in a slurry of paper pulp in an inverted position so that the coffin is formed on the mold with its open top facing downwardly; applying a suction to the interior of the mold to draw the paper pulp onto the face of the mold while it is in said inverted position whereby the paper pulp on the mold will tend to flow downwardly by gravity along the face of the mold to form a heavier concentration of pulp along the open edge of the coffin to strengthen this area of the coffin structure; removing the mold with the paper pulp on it out of the slurry of pulp; applying suction to the interior of the mold to remove water from the pulp that is on the mold and compacting it; and applying air pressure to the interior of the mold to release the papier-maché coffin from the mold.

2. The method of molding a coffin of papier-maché according to claim 1 including wrapping the mold with the paper pulp on it in an impervious blanket and retaining said blanket on the mold while the water is being suctioned out of the paper pulp on the mold to cause a greater amount of compaction of the pulp to increase the strength of the coffin.

3. The method of molding a coffin of papier-maché according to claim 1 including turning the mold with paper pulp on it to the upright position before applying said air pressure to the interior of the mold for releasing the papier-maché coffin from the mold whereby said coffin will be in the upright position when it is released from the mold.

4. The method of molding a coffin of papier-maché according to claim 2 including turning the mold with the paper pulp on it to the upright position before applying said air pressure to the interior of the mold for releasing the papier-maché coffin from the mold whereby said coffin will be in the upright position when it is released from the mold.

5. The method of molding a coffin of papier-maché according to claim 1 including applying heat to the papier-maché coffin to thoroughly dry it into its finished condition.

6. The method of molding a coffin of papier-maché according to claim 2 including applying heat to the papier-maché coffin to thoroughly dry it into its finished condition.

7. The method of molding a coffin of papier-maché according to claim 1 including retaining the mold with the paper pulp on it in the inverted position while suction is being applied to the interior of the mold for suctioning the water from the paper pulp after the mold has been withdrawn from the slurry.

* * * * *